US005732533A

United States Patent [19]

Focke et al.

[11] Patent Number: 5,732,533

[45] Date of Patent: Mar. 31, 1998

[54] PROCESS AND APPARATUS FOR PRODUCING PACKS WITH AN OUTER WRAPPER CONSISTING OF PAPER OR THE LIKE

[75] Inventors: Heinz Focke; Martin Stiller; Michael Schlenker, all of Verden, Germany

[73] Assignee: Focke & Co. (GmbH & Co.), Verden, Germany

[21] Appl. No.: 708,228

[22] Filed: Sep. 6, 1996

[30] Foreign Application Priority Data

Sep. 26, 1995 [DE] Germany ..... 195 35 649.7

[51] Int. Cl.[6] ..... B65B 11/32

[52] U.S. Cl. ..... 53/466; 53/234; 53/375.9; 53/463; 53/477

[58] Field of Search ..... 53/466, 463, 461, 53/416, 477, 228, 234, 375.9, 387.4

[56] References Cited

U.S. PATENT DOCUMENTS

| | | | |
|---|---|---|---|
| 1,084,593 | 1/1914 | De Escobales et al. . | |
| 1,499,505 | 7/1924 | Conley et al. | 53/375.9 X |
| 2,603,925 | 7/1952 | Moore | 53/375.9 X |
| 3,196,758 | 7/1965 | Saidel . | |
| 4,256,526 | 3/1981 | McDaniel | 156/295 |
| 4,711,065 | 12/1987 | Focke et al. | 53/170 |
| 5,024,709 | 6/1991 | Faulkner, III et al. | 156/69 |
| 5,447,014 | 9/1995 | Adams et al. | 53/375.9 X |

FOREIGN PATENT DOCUMENTS

| | | |
|---|---|---|
| 137334 | 4/1985 | European Pat. Off. . |
| 1511858 | 9/1965 | Germany . |
| 1252116 | 10/1967 | Germany . |
| 4117428 | 12/1992 | Germany . |
| 4241176 | 6/1994 | Germany . |
| 371985 | 10/1963 | Switzerland . |
| 1325802 | 8/1973 | United Kingdom . |

*Primary Examiner*—James F. Coan

*Attorney, Agent, or Firm*—Sughrue, Mion, Zinn, Macpeak & Seas, PLLC

[57] ABSTRACT

Process and apparatus for producing packs (10) with a wrapper (12) which is provided with glue locations in the region of folding tabs and walls. For the task of providing wrappers (12) for articles, in particular pack groups (29), consisting of paper or similar materials, folding tabs, closure tabs and walls are to be connected to one another by glue. The blanks for the wrapper (12) are severed from a continuous web (24). Glue locations, namely glue strips and glue patches, are applied onto the web (24) by a fixed glue unit (41) during a conveying movement. The glue used is a hot-melt material which hardens after being applied onto the web (24) and is activated by heat in the region of folding units, in particular of folding turrets (30), and in the region of a pack tower (36).

11 Claims, 5 Drawing Sheets

PROCESS AND APPARATUS FOR PRODUCING PACKS WITH AN OUTER WRAPPER CONSISTING OF PAPER OR THE LIKE

BACKGROUND OF THE INVENTION

The invention relates to a process for producing packs with an outer wrapper consisting of foldable packaging material, such as paper, in particular for producing cigarette bundle packs, with mutually overlapping and adhesively bonded folding and closure tabs of the outer wrapper, it being the case that, in a packaging machine, blanks of the outer wrapper are folded around pack contents by folding units, in particular after being severed from a continuous web of the packaging material. The invention further relates to an apparatus for carrying out the process.

The production of packs with wrappers consisting of thin packaging material, in particular paper, poses problems if folding or closure tabs are glued to one another or to walls of the packs. Gluing units by means of which cold-setting glue is applied, via nozzles, onto the regions of the wrapper which are to be adhesively bonded are usually installed in the packaging machine. In the event of breaks in operation, the glue units have to be removed and exchanged. On the whole, the use of (cold-setting) glue units directly in the sensitive region of the folding mechanism has not proved successful.

The use of hot melt, that is to say glue which is activated, and bonds adhesively, at increased temperatures is also known.

SUMMARY OF THE INVENTION

The object of the invention is to propose measures for the production of packs in the case of which outer wrappers or tabs of the same are glued after the folding operation without involving the disadvantages which are customary when cold-setting glue is used.

In order to achieve this object, the process according to the invention is defined by the following features:

a) the web of the packaging material and/or the blanks of the wrapper are provided, in the region of the packaging machine, with glue patterns in the form of spots or lines before the folding operation, b) the glue patterns consist of hot-melt glue, c) after being applied onto the web or the blanks, the glue patterns are hardened for the purpose of further transportation, d) the glue patterns are activated by heat directly during the operation of folding the blanks around the pack contents or thereafter, e) finally, the folding and closure tabs of the wrapper are adhesively bonded to one another by pressure being exerted.

Accordingly, in the case of the invention, the packaging-material webs, which are wound in the form of reels, are made available to the packaging machine in a state in which they are free of (hot-melt) glue locations. When the web is drawn off from the reel in the region of the packaging machine, glue is applied onto the web, to be precise the above described glue of the hot-melt type. In this arrangement, the glue locations or glue patterns are applied onto the web in a manner appropriate for the pack, that is to say in accordance with the necessary glue patterns of the blank for the wrapper or the finished pack. The glue locations or glue patterns harden thereafter; accordingly, they are initially inactive. The blanks are then severed at a precise position from the material web. In this case, the blanks for the wrapper have the (inactive) hot-melt glue locations. Thereafter, the blanks are folded in a conventional manner around the article which is to be wrapped, during which process the inactive glue locations do not cause any problems. The glue locations are activated, namely by applying heat, during the folding operation or after completion of the folding operation. The folding or closure tabs provided with the glue locations are then pressed against one another and thus adhesively bonded.

According to a further proposal of the invention, the glue is applied onto the web in the correct position during a transportation movement of the web of the packaging material relative to a fixed glue unit, to be precise it is applied preferably by glue nozzles, the opening duration of which can be controlled and determines the size of the glue patterns. In the case of wrappers for cigarette bundle packs or similar types of pack, the glue patterns are applied onto the web by controllable slot nozzles, the slot nozzles extending transversely to the conveying direction of the web.

Further features of the invention relate to process steps and the configuration of the apparatus. The process is explained in more detail hereinbelow with reference to an exemplary embodiment of the apparatus. In the drawings:

DESCRIPTION OF PREFERRED EMBODIMENTS

Figure 1:
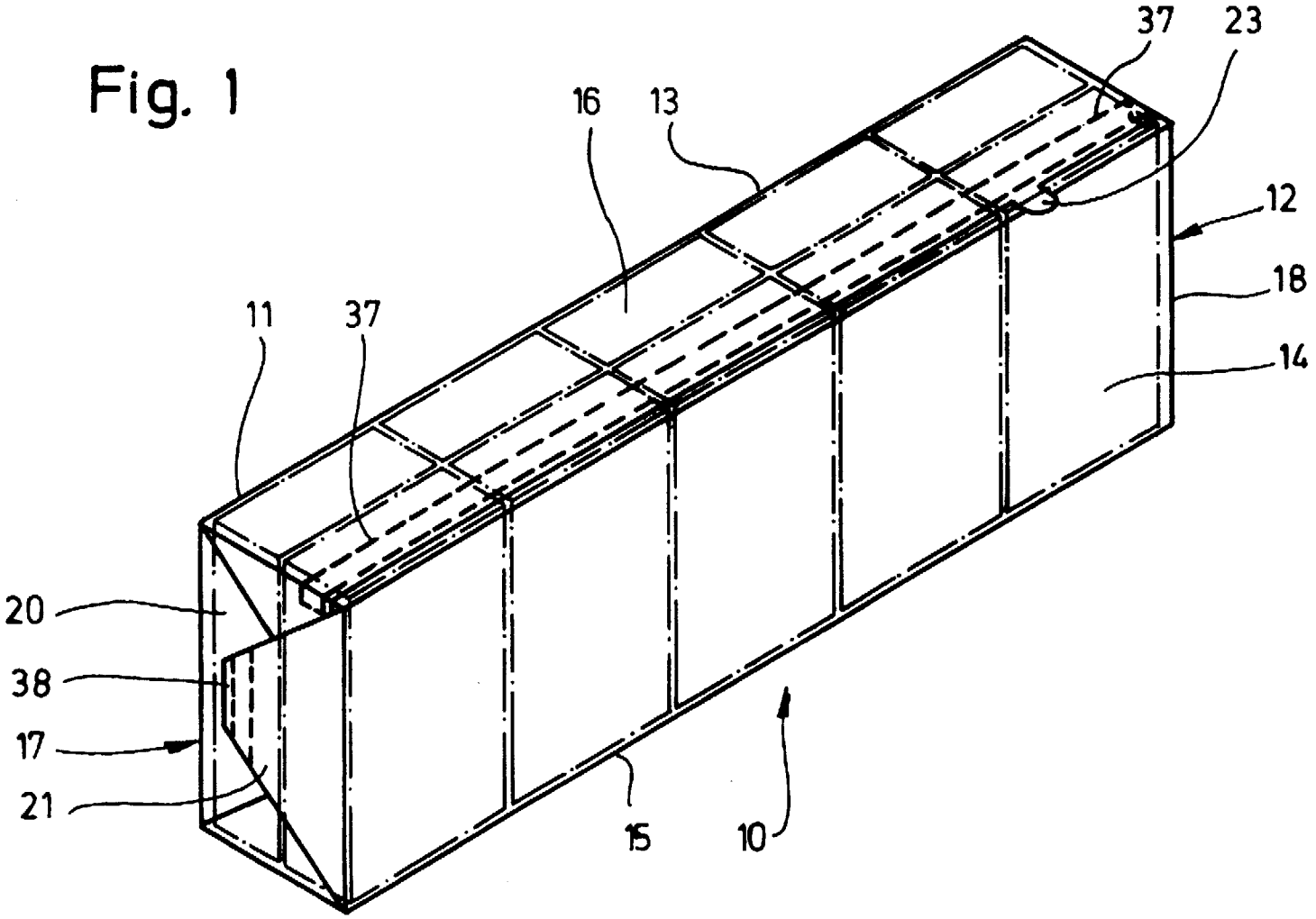
FIG. 1 shows a perspective illustration of an example of a pack, namely a cigarette bundle pack.
Figure 2:
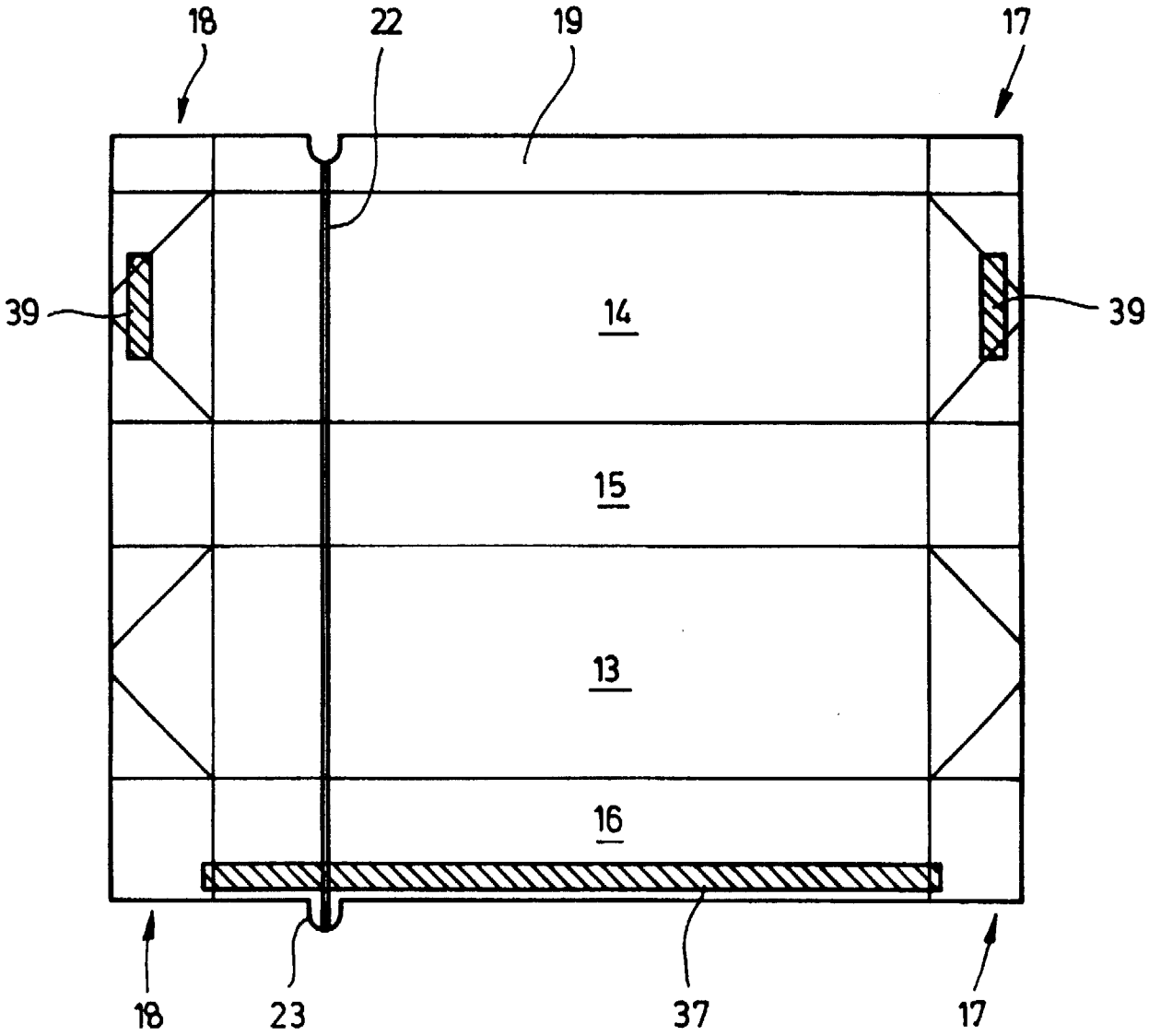
FIG. 2 shows a spread-out blank for the outer wrapper of the pack according to FIG. 1.

In the drawings, FIGS. 1 and 2 show details of an example of a pack 10. Said pack is a bundle pack for cigarettes, namely for a group of ten cigarette packs 11. The latter are arranged in two rows, forming a block in the process, and are enclosed by a wrapper 12. This consists of comparatively thin packaging material, in particular of paper or paper-like materials. A pack which is designed in this way is often referred to as a "cigarette-carton stick".

The wrapper 12 encloses the group of cigarette packs 11 on all sides, in the process forming a large-surface-area front wall 13, a corresponding rear wall 14 which is located opposite, a side wall 15 which is arranged between said front wall and rear wall, a border-side side wall 16, and end walls 17, 18 which are formed by folding. The side wall 16 is located on the border of a blank for the wrapper 12 (FIG. 2). In order to form a closed pack, the side wall 16 is connected to a connection strip 19 which is formed on that side of the blank for the wrapper 12 which is located opposite the side wall 16, that is to say adjoining the rear wall 14. The connection strip 19 and a sub-region of the side wall 16 overlap one another and are adhesively bonded to one another. In the present exemplary embodiment, the connection strip 19 is located on the inside, that is to say beneath the side wall 16.

The end walls 17, 18 are also formed by folding parts of the blank according to FIG. 2. An "envelope-type fold" is used in the present exemplary embodiment, triangular or trapezoidal folding tabs 20, 21 being formed in the process. These folding tabs partially overlap one another (FIG. 1) and are likewise adhesively bonded to one another.

Furthermore, the blank or the wrapper 12 is provided with a tear-open strip 22 which runs all the way around and is assigned a grip flap 23 on the border of the side wall 16.

The blanks for the wrapper 12 are severed from a continuous web 24 of the packaging material (paper or the like). The web 24, in turn, is drawn off from an extensive reel 25, which has to be replaced from time to time.

Figure 3:
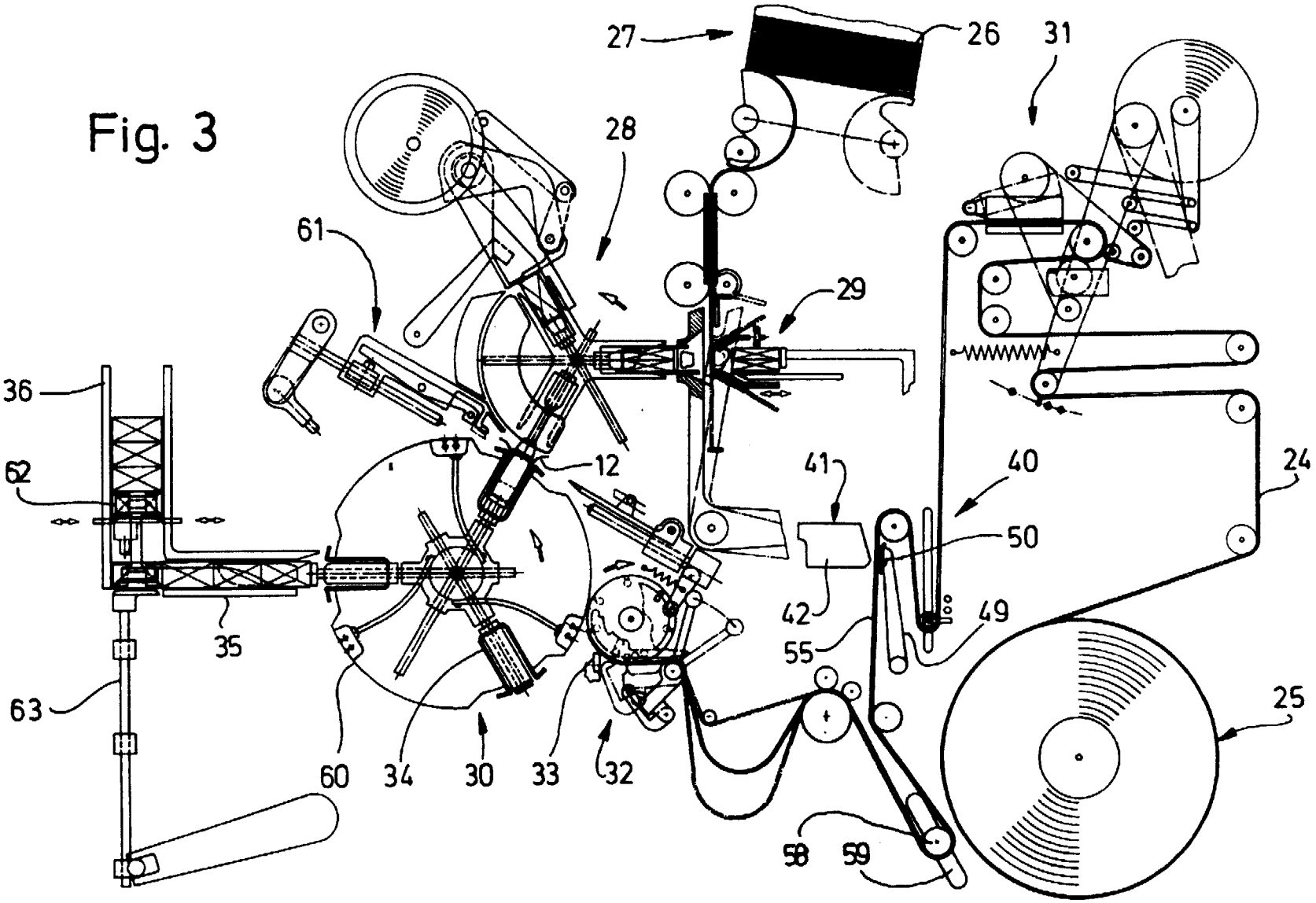
FIG. 3 shows a schematic side view of an apparatus for producing packs according to FIG. 1.

FIG. 3 shows an exemplary embodiment of a packaging machine which is suitable for the production of the packs 10. Details of said packaging machine are illustrated and described in EP 0 137 334/U.S. Pat. No. 4,711,065. This apparatus is intended for processing different materials for forming the wrapper 12. On the one hand, it can process web-form packaging material, to be precise alternatively paper or (plastic) film. Furthermore, however, it is also possible to use said apparatus for processing blanks 26 consisting of thin cardboard. In the case of this alternative, blanks which have been produced elsewhere are introduced into a magazine 27 in stacks and removed one after the other. A pack group 29 which has been formed is wrapped in the blank 26 in the region of a folding unit 28. Here too, folding tabs or wrapper walls are adhesively bonded to one another. The pack which has been finished in this way may then—if desired—additionally be packaged in a further outer wrapper consisting of film.

The alternative which is of prime importance here is that for processing paper or paper-like materials. This material is fed in the form of the web 24 to a separate packaging unit, namely to a folding turret 30. The web 24 is drawn off from the reel 25 in sections, that is to say cyclically. The tear-off strip 22 is fitted on the web 24 in the region of a strip unit 31. The material web 24 then passes into a cutting station 32. This has a cutter roller 33. In the region of the latter, blanks for the wrapper 12 are severed from the web 24 and transferred to the directly adjacent folding turret 30 in the correct position.

The blank of the wrapper 12 is folded around the pack group 29 of cigarette packs 11 in the region of the cyclically rotating folding turret 30. In the present exemplary embodiment, the pack group 29 is fed to the folding turret 30 via the folding unit 28, though without a wrapper. The pack group 29 is pushed into a pocket 34 of the folding turret 30, together with a blank of the wrapper 12. On further rotation of the folding turret 30, the wrapper 12 is folded, with the result that partially finished packs 10 are pushed out of the folding turret 30 in the region of a discharge station. The end walls 17, 18 are folded in the region of an adjoining rectilinear pack path 35, the folding tabs 20, 21 being formed in the process. The last folding step, namely the operation of folding over the outer folding tab 21 in the region of the end walls 17, 18, takes place in the region of a pack tower 36, that is to say in the region of an upright conveying section for the packs 10.

The wrapper 12 is held in the closed position by glue locations provided in selected regions. In the present preferred exemplary embodiment, an elongate glue strip 37 is provided in order to connect the side wall 16 to the connection strip 19. The glue strip 37 extends on the border of the side wall 16, over the entire length of the same. The glue strip 37 terminates in the region of folding tabs of the end walls 17, 18. The glue strip 37 is provided on the inside of the wrapper 12.

Further glue patches 38, 39 are located in the region of the end walls 17, 18. These rectangular glue patches 38, 39, which are likewise in the form of strips, extend in the region of the triangular or trapezoidal folding tabs 21. The glue patches 38, 39 are provided in the region where the folding tab 21 overlaps with the inner folding tab 20.

The glue for the glue strips 37 and glue patches 38, 39 can be activated by heat, so-called "hot-melt" glue. The special feature is that this glue is applied onto the web 24 of the packaging material or onto blanks in the region of the packaging machine and hardens in the region of the packaging machine prior to the folding steps, and advantageously upstream of the cutting station 32, with the result that all the packaging measures do not impair the provided glue pattern and, in addition, glue residues are not transferred onto elements belonging to the packaging machine. After completion of the folding operations or at a location which is expedient from a packaging point of view, the glue patterns of the wrapper 12 are then activated again by heat. Furthermore, pressure is used to connect together those folding tabs, walls, etc. which are to be connected to one another.

The packaging machine or the apparatus shown in FIG. 3 is provided with a special glue station 40. This is positioned so as to adjoin the strip unit 31 and at a sufficient conveying distance upstream of the cutting station 32. The glue patterns, namely the glue strip 37 and the glue patches 38, 39, are applied onto the web 24 in the glue station 40 such that the blanks produced in the cutting station 32 have glue locations which are provided in the correct position.

The glue station 40 comprises a glue unit 41. In the present case, the latter is designed such that all the glue locations in the entire glue pattern are applied at the same time.

The glue unit 41 comprises an application head 42. The latter is a glue-application member. The activated, that is to say heated, but in any case free-flowing glue is transferred onto the web 24 by the application head 42. For this purpose, the application head 42 is equipped with glue nozzles, in the present case with slot nozzles 43, 44 and 45. Each glue location is assigned a separate nozzle or slot nozzle, that is to say the glue strip 37 is assigned the elongate slot nozzle 44 and the glue patches 38, 39 are each assigned the short slot nozzles 43 and 45. The relative position of the slot nozzles 43 . . . 45 in a common transverse plane corresponds to the relative position of the glue locations on the web 24. The glue locations, namely the glue strip 37 and glue patches 38 and 39, are arranged at a distance from one another in the transverse direction of the web. Correspondingly, the slot nozzles 43, 44, 45 are arranged at a distance from one another in the transverse direction of the application head 42.

The glue is applied onto the web 24 during a movement phase of the web 24 in the longitudinal or conveying direction. With a predetermined conveying speed of the web 24, the open position of the respective slot nozzle 43 . . . 45 is dimensioned so as to achieve the desired dimension of the relevant glue location in the movement direction of the web 24. This means that, due to the small width of the glue strip 37 in the longitudinal direction of the web 24, the slot nozzle 44 is open during a very short period of time, whereas the slot nozzles 43 and 45 are held open over a longer period of time during the conveying movement of the web 24.

For the transfer of the glue locations the web 24 is pressed onto the glue unit 41 or the application head 42 in the region of the slot nozzles 43 . . . 45. The web 24 rests against the glue unit 41 with a certain degree of stress and follows the outer contour of the application head 42. The latter forms a jutting-out or protruding abutment surface for the web 24, in the present case with two abutment surfaces 46, 47 arranged at an angle with respect to one another. The slot nozzles 43 . . . 45 are arranged in the deflection region of the abutment surfaces 46, 47, that is to say in the region of a (rounded) jutting-out edge 48. The web 24 is moved past the glue nozzles or slot nozzles 43 . . . 45 with sliding or slipping action in order to be glued. In this arrangement, glue is applied onto the web 24 during the opening periods of the glue nozzles.

In the present case, the web 24 is pressed onto the application head 42 by a pressure-exerting member 49. The pressure-exerting member 49 comprises a plate-like pressure-exerting head 50 on a pivotable arm. The pressure-exerting head 50 is provided with a recess 51 in the region of the slot nozzles 43 . . . 45, with the result that the web 24 is pressed onto the abutment surfaces 46, 47 on either side of the slot nozzles 43 . . . 45. A leg 52 of the plate-like pressure-exerting head 50 causes the web 24 to be pressed onto the application head 42 or onto the lower, jutting-back abutment surface 47 of the same, to be precise during the glue transfer or for the purpose of the same.

After completion of a gluing cycle, the pressure-exerting member 49 or the pressure-exerting head 50 is retracted. By virtue of the web 24 being guided over upper and lower deflection rollers 53, 54, a vertically running section 55 of the web 24 is automatically released from the glue unit 41. This position is assumed in particular during the standstill phase of the web 24, which is advanced cyclically.

The necessary amount of glue is fed to the glue unit 41 or to the application head 42 via a glue line 56 from a supply (glue container) (not shown). As far as opening duration is concerned, each slot nozzle 43 . . . 45 can be controlled separately. Electrical connections 57 serve to control the opening and closing movements of the slot nozzles 43, 44, 45. Furthermore, a heating cartridge, which is likewise supplied with electricity, is installed within the application head 42.

The width of the slot nozzles 43, 44, 45 is extremely small, that is to say the width is, for example, 0.1 to 0.2 mm. This small opening width ensures that glue does not continue to run out after a slot nozzle 43, 44, 45 has been switched off or closed.

Figure 4:
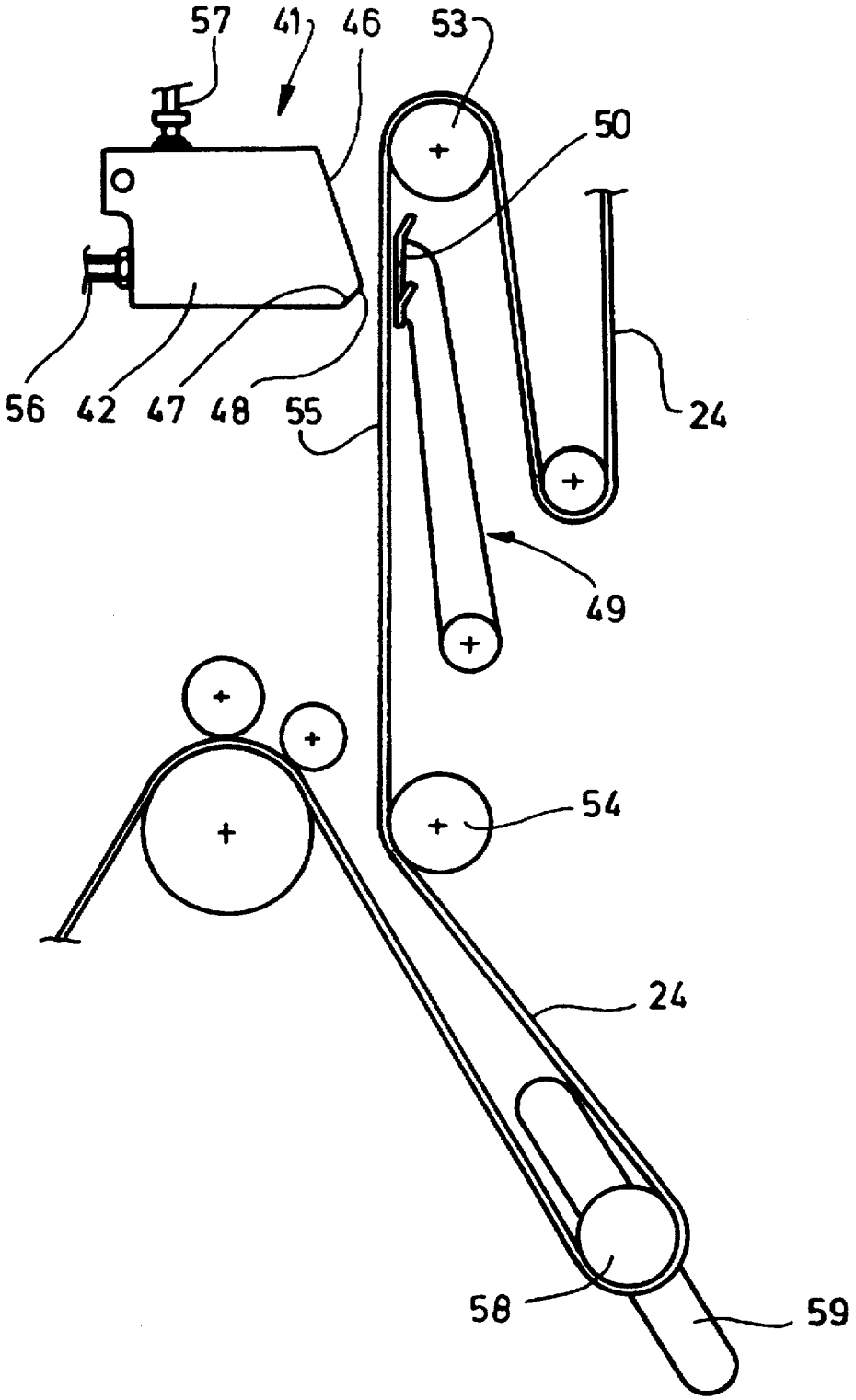
FIG. 4 shows, on an enlarged scale, a detail of the apparatus, namely a glue station.
Figure 5:
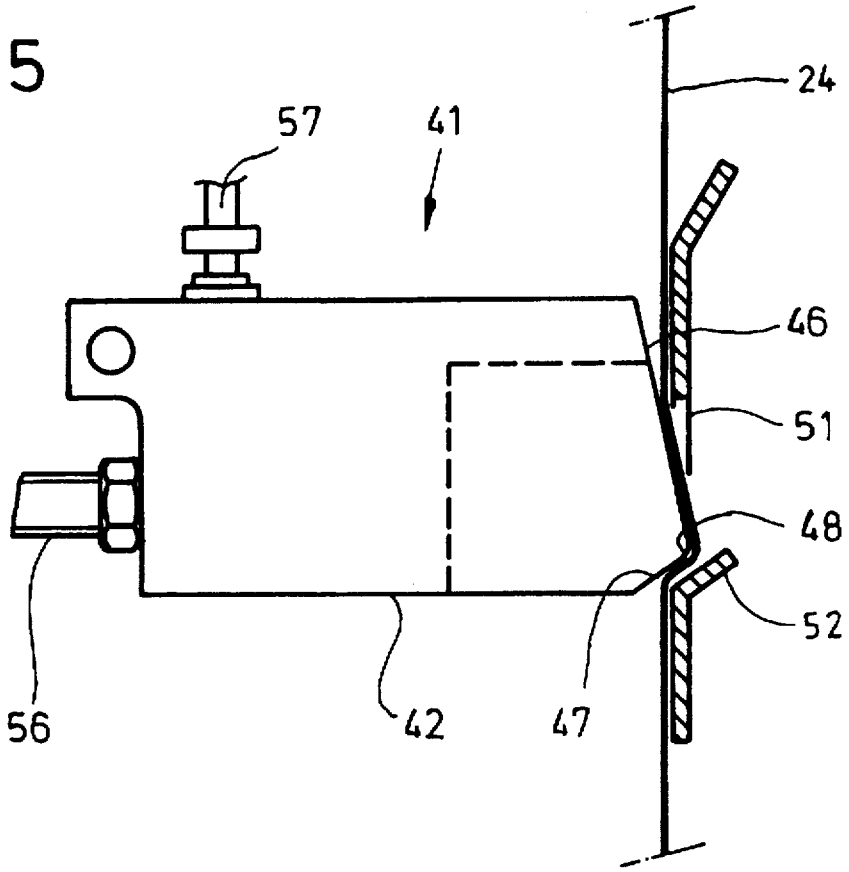
FIG. 5 shows, on a scale which is enlarged to an even greater extent, a glue unit as a detail of the station according to FIG. 4.
Figure 6:
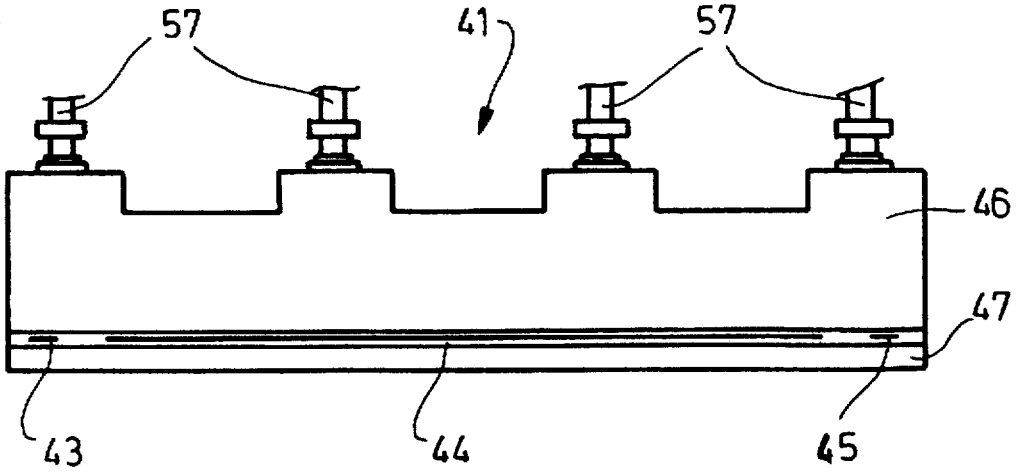
FIG. 6 shows a front view of the detail according to FIG. 5 (without the material web).

The web 24 is guided in a particular manner in a region adjoining the glue station 40 in the conveying direction (FIG. 4). The web 24, which is provided with glue which has already hardened, is guided over an adjustable deflecting roller, that is to say over an adjustment roller 58. The relative position of the latter can be adjusted (by hand) in order, by way of different conveying sections of the web 24, to permit adaptation to different formats of the packs 10 which are to be produced. For this purpose, the adjustment roller 58 is mounted such that it can be adjusted, but secured, in an obliquely directed slot 59.

In the present exemplary embodiment, the glue locations are first activated in the region of the folding turret 30, and thereafter by heat. The glue strip 37 for fixing the "flexible-tube fold" of the wrapper 12 is heated, and thus activated, by heating members or heating cartridges 60 which are positioned on the circumference of the folding turret 30, adjacent to the pockets 34. That blank of the wrapper 12 which is laid against the circumference of the folding turret 30 is located with the glue strip 37 in the region of the heating cartridge 60. After activation of the glue strip 37, a pressure-exerting member 61 presses the outer side wall 16 of the blank onto the connection strip 19, which has been folded beforehand, in order to produce the glue connection.

The glue patches 38, 39 for the folds of the end walls 17, 18 are first activated after leaving the folding turret 30, namely in the region of the pack path 35 or the pack tower 36. The latter is provided with a heating cartridge 62 above the pack path 35, to be precise on two opposite sides. The packs 10 are lifted one after the other from the pack path 35 by a lifting means 63 and are pushed upwards into the pack tower 36. In this arrangement, the outer folding tab 21, which, on account of the relative position of the pack 10, is located on the upper side of the same, is folded over against the end wall 17, 18. The folding tab 21 is pressed onto the folding tab 20 in the process. The activated glue patches 38, 39 produce the adhesive-bonding connection.

The apparatus is also suitable for processing films, which do not require folding tabs, etc. to be adhesively bonded. When the film material has been processed, the glue unit 41 is not operated. However, it is not necessary to remove the glue unit.

Blanks, for example the blanks 26, may be glued in an analogous procedure using glue units which correspond to the abovedescribed configuration.

What is claimed is:

1. A process for producing packs (10) with an outer wrapper (12) consisting of foldable packaging material and being formed by mutually overlapping and adhesively bonded folding and closure tabs of the wrapper (12), wherein, in a packaging machine, blanks of the wrapper (12) are severed from a continuous web (24) of the packaging material, and, in a folding operation, are folded around pack contents by folding units, said process comprising the steps of:

a) before the folding operation, applying to the web (24) of the packaging material, in a region of the packaging machine, glue patterns in the form of spots or lines;

b) choosing the glue patterns to be of hot-melt glue;

c) after the glue patterns are applied onto the material web (24), allowing the glue patterns to harden so that the hot-melt glue hardens to an inactive state for transportation of the web (24);

d) transporting the web (24), with the hardened and inactive glue patterns, to the pack contents to be wrapped;

e) activating the glue patterns by heat directly during the folding of the blanks around the pack contents or thereafter, and f) finally, pressing the folding and closure tabs of the wrapper (12) against one another so that they are adhesively bonded together by the activated glue patterns.

2. The process as claimed in claim 1, wherein in each case a plurality of glue patterns are applied onto the continuous web (24) in the relative position corresponding to the glue patterns of the blanks, and wherein, after the glue has hardened, the blanks are severed from the web (24) directly upstream of a first folding unit (30).

3. The process as claimed in claim 2, wherein the glue patterns, in particular glue strips (37) and glue patches (38, 39), are applied onto the web (24), which is conveyed cyclically, during a transportation phase of said web.

4. The process as claimed in claim 1, wherein the glue patterns are transferred onto the web (24) by a stationary glue unit (41), it being the case that, for the transfer of the glue patterns, the web (24) is pressed onto the glue unit (41) or onto abutment surfaces (46, 47) of an application head (42) with glue nozzles.

5. An apparatus for producing packs with a wrapper (12) surrounding contents of a pack, said wrapper consisting of foldable packaging material and being provided with mutually overlapping folding and closure tabs that are adhesively bonded to one another with glue, and blanks of the wrapper (12) being severable from a conveyed continuous web (24) of the packaging material, said apparatus comprising:

a) a glue unit (41) through which the continuous web (24) runs in a packaging machine;

b) means in the glue unit (41) for transferring hot-melt glue onto the web (24) in areas thereof corresponding to the wrapper's folding and closure tabs which are to be adhesively bonded together with glue, so that the hot-melt glue transferred onto the web (24) hardens into an inactive state;

c) folding units for folding the blanks;

d) means for transporting the web (24) bearing the hardened, inactive hot-melt glue into said folding units which fold the wrapper blanks around the pack contents; and e) heating members, associated with the folding units, for activating the hot-melt glue on the blanks during the folding of the blanks or immediately thereafter.

6. The apparatus as claimed in claim 5, wherein the glue unit (41) has a glue application head (42), against which the web (24) rests with sliding action, during the transportation of the web, for the purpose of transferring glue onto the web (24).

7. The apparatus as claimed in claim 6, wherein the the glue application head (42) is designed, on a side facing the web (24), with a protuberance for abutting the web (24).

8. The apparatus as claimed in claim 7, wherein glue nozzles for transferring glue onto the web (24) are fitted on the glue unit (41) with their longitudinal extent transverse to a conveying direction of the web (24), the glue nozzles, being adapted to be controlled as regards their open and closed position, and the dimensions of glue strips (37) and glue patches (38, 39) on the web being determined by durations for which the glue nozzles (43, 44, 45) are open.

9. The apparatus as claimed in claim 8, further comprising, for the transfer of glue, a pressure-exerting member (49) for pressing the web (24) temporarily onto the application head (42) during the conveying of the web (24), the pressure-exerting member (49) having a pressure-exerting head (50) which has a recess (51) in the region of the glue nozzles (43, 44, 45).

10. The apparatus as claimed in claim 9, further comprising deflection rollers (53, 54), wherein, in the region of the glue unit (41), the web (24) forms, by virtue of said deflection rollers (53, 54), an essentially upright section (55) which runs at a distance from the application head (42), the web (24) being deflectable by the pressure-exerting member (49) in a region of the section (55) until it butts against the application head (42).

11. The apparatus as claimed in claim 5, further comprising an adjustment roller (58) for the web (24) downstream of the glue unit (41), as seen in the conveying direction, in order to increase or reduce the transportation path of the web (24), the adjustment roller (58) being mounted in a slot (59).

* * * * *